US007059333B2

(12) United States Patent
Duqueroie

(10) Patent No.: US 7,059,333 B2
(45) Date of Patent: Jun. 13, 2006

(54) APPLICATION MEMBER, APPLICATION SYSTEM, AND METHOD

(75) Inventor: Florent Duqueroie, Paris (FR)

(73) Assignee: L'Oreal S.A., Paris (FR)

( * ) Notice: Subject to any disclaimer, the term of this patent is extended or adjusted under 35 U.S.C. 154(b) by 130 days.

(21) Appl. No.: 09/824,679

(22) Filed: Apr. 4, 2001

(65) Prior Publication Data

US 2001/0042553 A1 Nov. 22, 2001

(30) Foreign Application Priority Data

Apr. 5, 2000 (FR) ..... 00 04347

(51) Int. Cl.
*A45D 24/22* (2006.01)

(52) U.S. Cl. ..... 132/114; 132/112

(58) Field of Classification Search ..... 132/114, 132/115, 112, 113, 148, 147, 144; 401/208, 401/218, 13, 220, 219, 28
See application file for complete search history.

(56) References Cited

U.S. PATENT DOCUMENTS 1,501,089 A * 7/1924 Andrews ..... 132/114
3,754,557 A 8/1973 Moore
5,483,979 A * 1/1996 Bertieri ..... 132/114
5,555,899 A * 9/1996 Foreman ..... 132/114
5,676,480 A * 10/1997 Tosto ..... 401/10
5,778,902 A * 7/1998 Nagy ..... 132/200
5,845,651 A 12/1998 de Nervo
5,937,865 A 8/1999 Dhaliwal
6,009,881 A * 1/2000 Baudin et al. ..... 132/112
6,357,449 B1 * 3/2002 Chu et al. ..... 132/112

FOREIGN PATENT DOCUMENTS

| | | |
|---|---|---|
| DE | 69 01 735 | 1/1969 |
| EP | 0799588 | 10/1997 |
| EP | 0 943 260 | 9/1999 |
| JP | H10-45182 | 2/1998 |
| JP | H11-216392 | 8/1999 |

* cited by examiner

*Primary Examiner*—John J. Wilson
*Assistant Examiner*—Robyn Doan
(74) *Attorney, Agent, or Firm*—Finnegan, Henderson, Farabow, Garrett & Dunner LLP

(57) ABSTRACT

An application member for applying a product to a surface may comprise a base portion and a plurality of teeth extending from the base portion. Each of the plurality of teeth may be formed of an elastically deformable material and may comprise a free end and an end adjacent to the base portion. At least one of the teeth may further comprise a dispensing orifice at the free end and a passage configured to enable flow communication between the dispensing orifice and a reservoir associated with the application member. The application member may further comprise at least one wall on the base portion. The at least one wall may be located at least partially along a periphery of a region of the base portion from which at least some of the teeth extend and may be configured to collect product flowing from the dispensing orifice of the at least one of the teeth.

57 Claims, 2 Drawing Sheets

APPLICATION MEMBER, APPLICATION SYSTEM, AND METHOD

Figure 1:
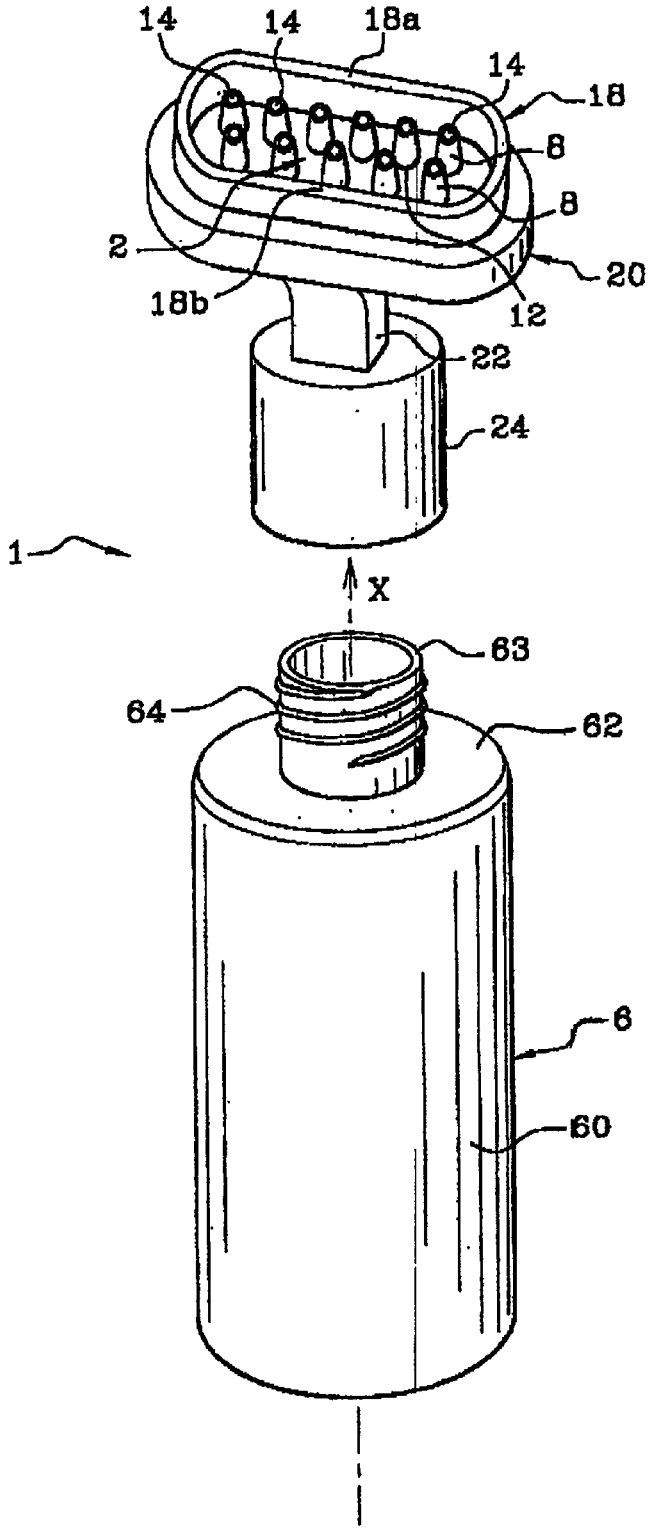

The invention relates to an application member for applying a product, such as a cosmetic or dermatological product, to a surface of a body. For example, the surface of the body may include the user's skin, hair, beard, moustache, and/or scalp. The invention also relates to an application system comprising an application member and a product reservoir. The invention further relates to a method of applying a product to a portion of the body of a user.

Applicators having a plurality of hollow applicating members, aligned in a straight or curved line, are known, in particular in the field of hair treatment such as dyeing of the hair. For example, U.S. Pat. No. 3,754,557 discloses an applicator comprising an elongate body that has an internal tube, which may be fed with a fluid product. A plurality of hollow applicating members in communication with the internal tube is arranged on the body. The ends of these applicating members form dispensing orifices and are arranged in a straight line, in the configuration of a comb. The elongate body, along with the applicating members, which are integrally attached thereto, are made of a rigid material.

DE-GM-69 01 735 discloses a device for applying and massaging a product into the scalp. This device comprises a rigid sole on which is implanted a plurality of hollow applicating members arranged in several rows in the manner of a brush. The ends of the applicating members are arranged on a plane. The rigid sole forms part of a product container having a deformable part. During application of the product, a pressure is exerted on the deformable part of the reservoir, bringing about expulsion of the product via the opening of the hollow members, while at the same time providing a massaging effect on the scalp.

The applicators described above have a number of drawbacks. For example, when a user does not take particular precautions, the end of some of the applicating members may rub against the scalp and cause irritation thereto. Users may find such rubbing to be unpleasant, or even problematic. Furthermore, the product may not be applied homogeneously, since a portion of the product may be applied to a part of the scalp while another portion of the product may be dispersed in hair surrounding the part of scalp impregnated with product. When this occurs, the user may be obliged to complete the application of the product using the fingers in order to obtain a homogeneous application. With these devices of the art, a treatment of the scalp alone, or alternatively a treatment of the hair alone without affecting the scalp, may not possible.

In light of the foregoing, there is a need in the art for an improved application member, application system, and method of applying a product.

An aspect of the invention may include an application member for applying a product to a surface. The application member may comprise a base portion and a plurality of teeth extending from the base portion. Each of the plurality of teeth may be formed of an elastically deformable material and may comprise a free end and an end adjacent to the base portion. At least one of the teeth may further comprise a dispensing orifice at the free end and a passage configured to enable flow communication between the dispensing orifice and a reservoir associate with the application member. The application member may further comprise at least one wall on the base portion. The at least one wall may be located at least partially along a periphery of a region of the base portion from which at least some of the plurality of teeth extend and may be configured to collect product flowing from the dispensing orifice of the at least one of the teeth. For example, the at least one wall and a surface of the base portion may form a drip pan to collect product flowing from the dispensing orifice of the at least one of the teeth.

In an embodiment, the plurality of teeth may extend from a substantially planar surface of the base portion, in a direction substantially perpendicular thereto. The at least one wall may also optionally extend from the substantially planar surface of the base portion, in a direction substantially perpendicular thereto.

In another embodiment, the plurality of teeth and the base portion may be a single piece, unitary construction formed, for example, by molding.

In an additional embodiment, at least some of the plurality of teeth may have a frustoconical shape tapering from a larger cross-section adjacent to the base portion to a smaller cross-section adjacent to the free end.

In still another embodiment, each of the plurality of teeth may have a frustoconical shape tapering from a larger cross-section adjacent to the base portion to a smaller cross-section adjacent to the free end. A length of each of the plurality of teeth from the base portion to the free end may be substantially the same.

In yet another embodiment, a height of the at least one wall above the base portion may not be more than a length of any of the plurality of teeth from the base portion to the free end, and the height of at least a portion of the at least one wall above the base portion may be substantially the same as the length of at least one of the plurality of teeth from the base portion to the free end.

In an additional embodiment, the at least one wall may surround the plurality of teeth.

In another embodiment, the height of the at least one wall above the base portion may vary along its length. For example, the length of each of the plurality of teeth may be substantially the same, and the at least one wall may have a first portion having a height substantially the same as the length of each of the plurality of teeth and a second portion having a height less than the length of each of the plurality of teeth. The height of the at least one wall may taper from the first portion to the second portion.

In a further embodiment, the at least one wall may comprise a free edge defining a first plane. The first plane may be inclined with respect to a second plane substantially including a surface of the base portion from which the teeth extend.

The at least one wall may also be formed of an elastically deformable material. For example, the application member may be formed of at least one of a natural rubber, a synthetic rubber, a foam such as a polyurethane, and a thermoplastic elastomer.

The elastically deformable material may have a Young's flexural modulus of not more than about 200 MPa and may have a Shore A hardness of from about 30 to about 60.

In another aspect, the invention may include an application system comprising one of the application members described above and a support configured to be associated with the application member and the reservoir. The support may include at least one channel configured to be placed in flow communication with the passage of the at least one of the teeth. The channel may enable dispensing of a product contained in the reservoir via the dispensing orifice of the at least one of the teeth. The system may optionally further comprise a reservoir configured to be coupled to the support and to contain a product.

In an embodiment, the application member is a single piece, unitary construction configured to be removably coupled to the support. The support may be formed of at least one of a rigid and a semi-rigid material. Optionally, the support may be curved along at least a portion of a length thereof.

In another embodiment, the reservoir may comprise a body having at least one elastically deformable wall. The reservoir may be configured to provide a handle member for a user of the system.

The reservoir may contain a product, for example, the reservoir may contain a product configured to be applied to at least one of skin and hair, such as dyes for keratin material, shampoos, hair conditioners, and dermatological compositions for the skin and/or the scalp.

In still another embodiment, the support may include a first tubular portion and a second tubular portion. The first tubular portion may be configured to be coupled to the application member and the second tubular portion may be configured to be coupled to a reservoir. The channel of the support may be defined by at least a portion of an interior of the first tubular portion. Optionally, an outer diameter of the first tubular portion may be less than an outer diameter of the second tubular portion.

In an additional embodiment, the second tubular portion and the reservoir may each include threading, wherein the threading of the second tubular portion and the threading of the reservoir are configured to engage one another to thereby couple the second tubular portion and the reservoir. Optionally, the first tubular portion may be curved along at least a portion of a length thereof.

In another embodiment, a longitudinal axis of at least one of the plurality of teeth may not be parallel to a longitudinal axis of the reservoir when the application member, the support, and the reservoir are coupled together.

In a further aspect, the invention may include a method of applying a product to a portion of a body. For example, the product may be applied to at least one of the scalp, the beard, the moustache, the hair, and skin other than the scalp. The method may comprise providing one of the application systems described above including an application member, a support, and a reservoir containing a product. The method may also include placing at least some of the plurality of teeth in contact with the portion of the body, and dispensing the product onto the portion of the body via the dispensing orifice of the at least one of the teeth.

In an embodiment, the reservoir may comprise a body having at least one elastically deformable wall, and the method may further comprise deforming the at least one elastically deformable wall to cause the dispensing of the product.

In another embodiment, the method may further comprise collecting product along the at least one wall of the application member, and applying the collected product to the portion of the body. For example, the collected product may be applied with the at least one wall.

In a further embodiment, the contacting may comprise deforming at least one of the teeth. For example, the contacting may comprise deforming at least some of the plurality of teeth to conform to a shape of the portion of the body. In one embodiment, the deforming may comprise deforming at least one of the teeth so that the dispensing orifice dispenses the product in a direction substantially tangential to a surface of the portion of the body.

Optionally, the at least one wall may be formed of an elastically deformable material, and the method may further comprise deforming the at least one wall by contacting the at least one wall and the portion of the body. In an embodiment, the deforming of the at least one wall comprises deforming the at least one wall to conform to a shape of the portion of the body.

In another aspect, the method may include coupling the application member and the support, and coupling the support and a reservoir containing a product. The method may also include uncoupling the application member and the support, and uncoupling the support and the reservoir, for example, after use of the application system to clean the system.

In still another embodiment, the method may include providing a system wherein the at least one wall of the application member includes a first portion having a height substantially the same as the length of each of the plurality of teeth and a second portion having a height less than the length of each of the plurality of teeth. The first portion and the second portion of the at least one wall may be located on substantially opposite sides of the base portion. The method may include orienting the application member so that the second portion of the at least one wall of the application member faces toward a predetermined direction, and moving the application member along the portion of the body in the predetermined direction.

Another aspect of the present invention may include an application member capable of depositing a particular amount of product homogeneously onto a surface of the body. Geometry and constitution of the application member may be suitable for the morphology of the surface to be treated (e.g., scalp, hair, beard, moustache, and skin other than the scalp). The application member may be flexible, supple, and soft, especially given the sensitivity of the skin, so as to substantially avoid any irritation thereof. The application member may have dispensing orifices that can be oriented individually on a surface of variable morphology, and this being possible during the treatment. Also, the application member may be able to spread the product quickly and homogeneously over a relatively large surface.

In an additional aspect, the application member may comprise a plurality of teeth each having a free end and an opposite end that is solidly attached to a base unit. The base unit may comprise at least one peripheral wall forming a drip tray around all or some of the teeth. The free end of at least one of the teeth may be provided with a dispensing orifice. A passage may be included for placing a reservoir containing a product in communication with the at least one dispensing orifice. According to the invention, the teeth may be made of an elastically deformable material.

The peripheral wall forming the drip tray may be made in continuous or discontinuous form. Where appropriate, it may be made only on one end of the base unit, juxtaposed to only some of the teeth.

The invention may also relate to an applicator assembly comprising a reservoir which is intended to contain the product to be dispensed and which can receive a support carrying an application member as defined above. The support may be configured so as to allow the product to be brought to the dispensing orifices of the teeth.

The teeth may form a single component with the base unit, which may be obtained by molding a suitable material.

In an embodiment, the teeth may be of frustoconical shape, with a cross-section decreasing from the base unit to the dispensing orifice. This arrangement may allow good penetration of the teeth into the hair.

According to an embodiment, the free edge of the wall may define a plane inclined relative to a mid-plane of the base unit.

The application member may be made of natural or synthetic rubber, of elastically deformable foam, and in particular of polyurethane or of a conventional thermoplastic elastomer. When a foam is used, a foam with closed or semi-open cells may be chosen. Moreover, all or part of the application member may be provided with a flock coating.

Making the application member from an elastically deformable material may optionally provide the certain effects and advantages. For example, all of the dispensing orifices may be placed in contact with a non-planar surface, such as the scalp or other parts of the body, thus making it possible to apply the product homogeneously onto a relatively large surface. By virtue of the ability of the hollow teeth to undergo multidirectional deformation (e.g., via axial compression and lateral flexure), all of the ends of the teeth may be able to come into contact with the scalp (or any other surface to be treated). As a result, great softness on application, which is non-aggressive to the surface to be treated, may also obtained, thereby preventing irritations that could be obtained with an application member having rigid teeth.

Under certain application conditions, for example, onto a surface with prominent portions, some of the teeth may bend, such that the product is distributed tangentially to the surface. Similarly, the wall delimiting the drip tray may be capable of deforming and adapting to the morphology of the surface to be treated.

The provision of a drip tray around all or some of the teeth by means of the wall may make it possible, where necessary, to collect an excess of product, during the movement of the application member over the surface during treatment. This drip tray may in certain cases provide a micro-reserve of product. The wall delimiting the drip tray may act as a member for spreading the product.

The deformability of the teeth or of the wall may include a flexure component, which reflects an ability of the teeth or of the wall to bend in response to a stress, and to return by elasticity substantially to its initial shape when the stress ceases. The flexibility of a material forming the application member may be characterized by its flexural modulus. For example, the materials envisaged by the invention may have a flexural modulus of not more than about 200 MPa (Young's flexural modulus). The flexibility of the teeth and of the peripheral wall may result from the nature of the material forming the application member and possibly from their configuration.

Optionally, the elastically deformable material from which the application member is made may have a Shore A hardness of from about 30 to about 60.

The application member as defined above may be combined with other components to form an applicator assembly, comprising a reservoir intended to contain the product to be dispensed. This reservoir may be capable of receiving a support, the support carrying the application member. Optionally, the support may comprise at least one passage capable of conveying the product to the dispensing orifices.

In an embodiment, the support may be made of a rigid or semi-rigid material. The application member may be fixed to the support by, for example, twin injection-molding, bonding, welding, crimping or any suitable means. It may be possible to mount the application member removably on the support, in order to permit cleaning of the application member and/or the support.

With regard to the reservoir, it may be compressible. Optionally, the reservoir may be configured such that it can serve as a handle member. For example, during a spreading movement over the profile of a surface to be treated, the user may hold the assembly in one hand, while having the possibility of simultaneously metering out the product during dispensing, by exerting a suitable pressure on the walls of the reservoir.

The application assembly of the invention may be suitable in particular for applying a product of more or less fluid consistency, for example, to the skin, the scalp, a beard, a moustache, or the hair.

Examples of products that may be applied using the applicator assembly may include dyes for keratin materials, shampoos, hair conditioners, dermatological compositions for treating skin or scalp complaints such as dandruff or psoriasis, etc.

Aside from the structural and procedural arrangements set forth above, the invention could include a number of other arrangements, such as those explained hereinafter. It is to be understood that both the foregoing description and the following description are exemplary.

Figure 2:
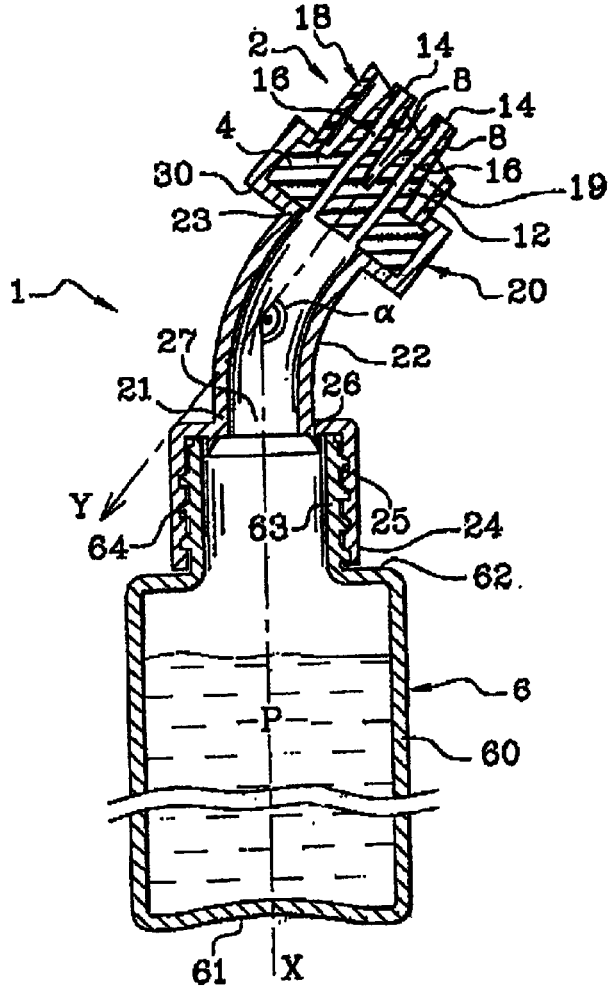
Figure 3:
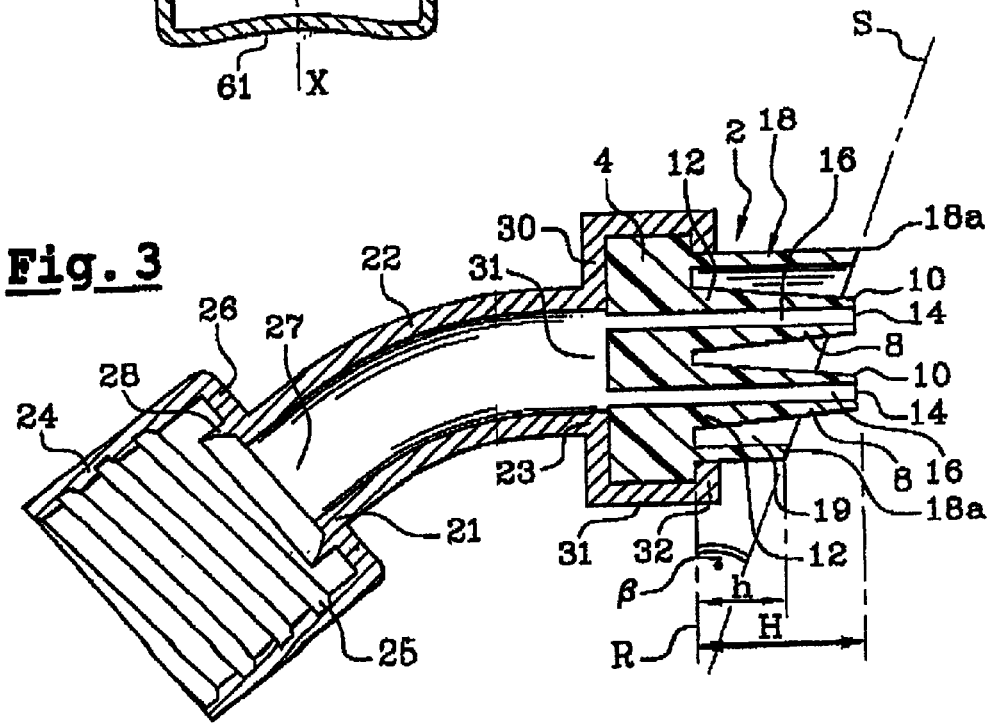

The accompanying drawings are included to provide a further understanding of some aspects of the invention and are incorporated in and constitute a part of this specification. The drawings illustrate embodiments of the invention and, together with the description, serve to explain some of the optional principles of the invention. In the drawings, FIG. 1 is a perspective view of an application system in accordance with the invention;

FIG. 2 is a view in axial cross-section of the application system of FIG. 1; and FIG. 3 is an enlarged view in axial cross-section of an application member and support in accordance with the invention.

Reference will now be made in detail to some embodiments of the invention, examples of which are illustrated in the accompanying drawings. Wherever possible, the same reference numbers are used in the drawings and the description to refer to the same or like parts.

FIGS. 1 and 2 illustrate an exemplary embodiment of an application system 1 for applying a product P (e.g., a fluid product) to a surface. This system 1 may include a reservoir 6 containing the product P and an application member 2 for applying the product. In an embodiment, the application member 2 may be fixedly coupled to a support 20. Alternatively, the application member 2 may be removably coupled to the support 20. The support 20 may comprise coupling means 22, 24 for coupling (e.g., fixing) the application member 2 to the reservoir 6 and establishing a flow communication between the reservoir 6 and the application member 2.

The reservoir 6 may comprise a bottle with a longitudinal axis X having a body 60. The body 60 may optionally have an oval or circular cross-section, and a closed base 61. On a portion opposite to the base 61, the reservoir 6 may form a shoulder 62, extending, for example, in the form of a cylindrical neck 63 whose cross-section is smaller than a cross-section of at least a portion of the reservoir 6.

The neck 63 may comprise external threading 64. The reservoir 6 may be configured so as to be held easily in a hand of a user. Thus, during the use of the application system 1, the body 60 of the reservoir 6 may serve as a handle member.

Optionally, a connecting ring 24 fitted with internal threading 25, complementary to the external threading 64 of the neck, may be coupled to the neck 63 by screwing. The connecting ring 24 may comprise a top face 26 delimiting a channel 27. This channel 27 may open at a first end 21 of a carrier channel 22. The carrier channel 22 may be bent at an angle of, for example, about 40°, such that a second end 23 of the channel 27 is oriented along a second axis Y. The second axis Y may form an angle α of about 140° with the axis X. The connecting ring 24 may optionally comprise a leakproofing rim 28 to permit leakproof mounting of the ring 24 on the neck 63 of the reservoir 6.

The second end 23 of the carrier channel 22 may be coupled to the support 20. The support 20 may comprise a base 30 (FIG. 3) whose cross-section is optionally larger than the cross-section of the carrier channel 22. The base 30 may be of substantially oval shape, substantially rectangular shape with the small sides having a semicircular configuration, or of any other appropriate shape. A peripheral wall 31 may be connected to the base 30 and may optionally extend perpendicularly thereto. The peripheral wall 31 may surround the base 30 over a short height. An edge 32 formed on the free end of the peripheral wall 31 may be folded at 90°, forming an inward projection toward the axis Y.

The peripheral wall 31 and the edge 32 may delimit a housing capable of removably maintaining the application member 2 on the base 30.

The application member 2 may have a base portion 4, inserted inside the peripheral wall 31, and gripped between the base 30 and the edge 32. An exposed surface of the base portion 4 may carry a plurality of teeth 8, optionally oriented substantially perpendicularly to a plane substantially including the exposed surface of the base portion 4. As shown in FIG. 1, the teeth 8 may be arranged in two rows, the teeth of a first row being arranged in a staggered manner relative to the teeth of a second row.

In the embodiment of FIG. 1, all of the teeth 8 are of substantially equal length H. Alternatively, the teeth 8 may have different lengths. The teeth 8 may have a frustoconical, longitudinal cross-section, wherein a base 12 of the cone is solidly attached to the base portion 4. Each of the teeth 8 may have a free end 10 provided with a dispensing orifice 14. The dispensing orifices 14 may communicate with the carrier channel 22 by means of passages 16 inside the teeth 8 and across the thickness of the base portion 4. Thus, the inside of the reservoir 6 may be in communication with each dispensing orifice 14.

At least one wall 18 may be located at least partially along a periphery of a region of the base portion 4 from which at least some of the teeth 8 extend. Optionally, the wall 18 may at least partially surround all or some of the teeth 8. Thus, the peripheral wall 18 and the outer surface of the base portion 4 may form a drip tray 19 around the teeth 8.

The height h of the peripheral wall 18 may be determined by a free edge 18*a*. As shown in FIGS. 1–3, the height h of the peripheral wall 18 may vary. For example, the free edge 18*a* may be in a plane inclined relative to a plane substantially including the outer surface of the base portion 4. According to an embodiment, the angle of inclination may be about 30°. For ergonomic reasons, this angle may be on the side of the larger curvature of the carrier channel 22.

The material forming the application member 2 may be a material that is elastically deformable, for example, in flexure and in axial compression. The material may be chosen from natural or synthetic rubbers, and optionally from thermoplastic elastomers. An elastomer foam with closed or semi-open cells may be chosen. Optionally, all or some of the outer surface of the teeth 8 and/or of the surface of the wall 18 may be flocked, which may make it possible, where necessary, to spread the product more uniformly.

To apply the product P contained in the reservoir 6 to a surface, for example, in order to carry out a treatment of the scalp, the user may hold the application system 1 by the body 60 of the reservoir 6. The user may then direct the application member 2 downwards and place the free ends of the teeth 8 on the head, pressing gently in the direction of the head. By virtue of the deformability of the teeth, some of the teeth 8 may undergo greater flexure and/or compression than the others, such that substantially all of the dispensing orifices 14 may be in the proximity of the scalp. By exerting a suitable pressure on the deformable walls of the body of the reservoir 60, the user may force the product P out of the dispensing orifices 14. By moving the application member 2 along the scalp, while continuing the dispensing of the product, it may be possible to treat a large area of the scalp. This operation may be repeated to treat, as desired, all the areas of the scalp.

In an embodiment, the application member 2 may be oriented so that a first portion of the peripheral wall 18 having a shorter height h faces toward a predetermined direction, and the application member 2 may be moved along the portion of the body in the predetermined direction (e.g., in the direction of the greatest curvature of the carrier channel 22 in the embodiment shown in FIG. 2). A second portion of the wall 18 having a larger height H and being opposite to the first portion may be adapted to the profile of the head. Since the second portion of larger height may follow the displacement movement of the teeth 8, the second portion may recover at least a portion of the excess product that may accumulate or collect in the drip tray 19. In addition, the second portion of larger height H may participate in spreading the product over the surface to be treated.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. An application member for applying a product to a surface, the application member comprising:

a base portion;

a plurality of teeth extending from the base portion, each of the plurality of teeth being formed of an elastically deformable material and comprising a free end and an end adjacent to the base portion, at least one of the teeth further comprising a dispensing orifice at the free end, and a passage configured to enable the dispensing orifice to be placed in flow communication with a reservoir configured to contain a product; and at least one wall on the base portion, the at least one wall being located at least partially along a periphery of a region of the base portion from which at least some of the teeth extend and being configured to collect product flowing from the dispensing orifice of the at least one of the teeth.

2. The application member of claim 1, wherein the plurality of teeth and the base portion comprise a single piece, unitary construction formed by molding.

3. The application member of claim 2, wherein at least some of the plurality of teeth have a frustoconical shape tapering from a larger cross-section adjacent to the base portion to a smaller cross-section adjacent to the free end.

4. The application member of claim 3, wherein each of the plurality of teeth has a frustoconical shape tapering from a larger cross-section adjacent to the base portion to a smaller cross-section adjacent to the free end.

5. The application member of claim 1, wherein a length of each of the plurality of teeth from the base portion to the free end is substantially the same.

6. The application member of claim 1, wherein a height of the at least one wall above the base portion varies along its length.

7. The application member of claim 6, wherein the at least one wall comprises a free edge defining a first plane, the first plane being inclined with respect to a second plane substantially including a surface of the base portion from which the teeth extend.

8. The application member of claim 1, wherein the at least one wall is formed of an elastically deformable material.

9. The application member of claim 1, wherein the application member is formed of a material chosen from a natural rubber, a synthetic rubber, a foam, and a thermoplastic elastomer.

10. The application member of claim 9, wherein the application member is formed of the foam, and wherein the foam includes polyurethane.

11. The application member of claim 1, wherein the elastically deformable material has a Young's flexural modulus of not more than about 200 MPa.

12. The application member of claim 1, wherein the elastically deformable material has a Shore A hardness of from about 30 to about 60.

13. The application member of claim 1, wherein the at least one wall surrounds the plurality of teeth.

14. The application member of claim 1, wherein the plurality of teeth extend from a substantially planar surface of the base portion, in a direction substantially perpendicular thereto.

15. The application member of claim 14, wherein the at least one wall extends from the substantially planar surface of the base portion, in a direction substantially perpendicular thereto.

16. The application member of claim 1, wherein the at least one wall extends from a substantially planar surface of the base portion, in a direction substantially perpendicular thereto.

17. The application member of claim 1, wherein the at least one wall and a surface of the base portion form a drip pan to collect product flowing from the dispensing orifice of the at least one of the teeth.

18. An application system comprising:

the application member of claim 1; and a support having one end intended to be associated with the application member and another end intended to be associated with the reservoir, the support including at least one channel configured to provide product flow from the reservoir to the passage of the at least one of the teeth.

19. The system of claim 18, wherein the application member is a single piece, unitary construction configured to be removably coupled to the support.

20. A method of applying a product to a portion of a body, the method comprising:

providing the system of claim 19;

coupling the application member and the support together;

coupling the support to a reservoir containing a product;

placing at least some of the plurality of teeth in contact with a portion of a body; and dispensing the product onto the portion of the body via the dispensing orifice of the at least one of the teeth.

21. The method of claim 20, further comprising uncoupling the application member and the support, and uncoupling the support and the reservoir.

22. The system of claim 18, further comprising the reservoir, wherein the reservoir is configured to be coupled to the support.

23. The system of claim 22, wherein the reservoir comprises a body having at least one elastically deformable wall.

24. The system of claim 22, wherein the reservoir is configured to provide a handle member.

25. The system of claim 22, wherein the reservoir contains a product.

26. The system of claim 25, wherein the product is configured to be applied to at least one of the scalp and the hair.

27. The system of claim 25, wherein the product includes at least one of dyes for keratin material, shampoos, hair conditioners, and dermatological compositions for at least one of the skin and scalp.

28. A method of applying a product to a portion of a body, the method comprising:

providing the system of claim 25;

placing at least some of the plurality of teeth in contact with a portion of a body; and dispensing the product onto the portion of the body via the dispensing orifice of the at least one of the teeth.

29. The method of claim 28, wherein the reservoir comprises a body having at least one elastically deformable wall, and wherein the method further comprises deforming the at least one elastically deformable wall to cause the dispensing of the product.

30. The method of claim 28, further comprising collecting product along the at least one wall of the application member, and applying the collected product to the portion of the body.

31. The method of claim 30, wherein the applying of the collected product comprises applying the collected product with the at least one wall.

32. The method of claim 28, wherein the placing comprises deforming at least one of the teeth.

33. The method of claim 32, wherein the deforming comprises deforming the at least one of the teeth so that the dispensing orifice dispenses the product in a direction substantially tangential to a surface of the portion of the body.

34. The method of claim 28, wherein the placing comprises deforming the at least some of the plurality of teeth to conform to a shape of the portion of the body.

35. The method of claim 28, wherein the at least one wall is formed of an elastically deformable material, and wherein the method further comprises deforming the at least one wall by contacting the at least one wall with the portion of the body.

36. The method of claim 35, wherein the deforming of the at least one wall comprises deforming the at least one wall to conform to a shape of the portion of the body.

37. The method of claim 28, wherein the placing comprises placing at least some of the plurality of teeth in contact with at least one of a scalp, a beard, a moustache, hair, and skin.

38. The system of claim 22, wherein a longitudinal axis of at least one of the plurality of teeth is not parallel to a longitudinal axis of the reservoir when the application member, the support, and the reservoir are coupled together.

39. The system of claim 18, wherein the support is formed of at least one of a rigid and a semi-rigid material.

40. The system of claim 18, wherein the support includes a first tubular portion and a second tubular portion, the first tubular portion being configured to be coupled to the application member, the second tubular portion being configured to be coupled to the reservoir.

41. The system of claim 40, wherein the channel is defined by at least a portion of an interior of the first tubular portion.

42. The system of claim 40, wherein an outer diameter of the first tubular portion is less than an outer diameter of the second tubular portion.

43. The system of claim 40, further comprising a reservoir configured to be coupled to the support and to contain a product, wherein the second tubular portion and the reservoir each include threading, the threading of the second tubular portion and the threading of the reservoir being configured to engage one another to thereby couple the second tubular portion and the reservoir.

44. The system of claim 40, wherein the first tubular portion is curved along at least a portion of a length thereof.

45. The system of claim 18, wherein the support is curved along at least a portion of a length thereof.

46. The application member of claim 1, wherein a plurality of the teeth further comprises the dispensing orifice and the passage.

47. The application member of claim 1, wherein each of the teeth further comprises the dispensing orifice and the passage.

48. An application member for applying a product to a surface, the application member comprising:

a base portion;

a plurality of teeth extending from the base portion, each of the plurality of teeth being formed of an elastically deformable material and comprising a free end and an end adjacent to the base portion, at least one of the teeth further comprising a dispensing orifice at the free end, and a passage configured to enable the dispensing orifice to be placed in flow communication with a reservoir configured to contain a product; and at least one wall on the base portion, the at least one wall being located at least partially along a periphery of a region of the base portion from which at least some of the teeth extend and being configured to collect product flowing from the dispensing orifice of the at least one of the teeth, wherein a height of the at least one wall above the base portion is not more than a length of any of the plurality of teeth from the base portion to the free end.

49. An application member for applying a product to a surface, the application member comprising:

a base portion;

a plurality of teeth extending from the base portion, each of the plurality of teeth being formed of an elastically deformable material and comprising a free end and an end adjacent to the base portion, at least one of the teeth further comprising a dispensing orifice at the free end, and a passage configured to enable the dispensing orifice to be placed in flow communication with a reservoir configured to contain a product; and at least one wall on the base portion, the at least one wall being located at least partially along a periphery of a region of the base portion from which at least some of the teeth extend and being configured to collect product flowing from the dispensing orifice of the at least one of the teeth, wherein a height of at least a portion of the at least one wall above the base portion is substantially the same as a length of at least one of the plurality of teeth from the base portion to the free end.

50. The application member of claim 49, wherein the length of each of the plurality of teeth is substantially the same, and wherein the at least one wall has a first portion having a height substantially the same as the length of each of the plurality of teeth and a second portion having a height less than the length of each of the plurality of teeth.

51. The application member of claim 50, wherein the height of the at least one wall tapers from the first portion to the second portion.

52. A method of applying a product to a portion of a body, the method comprising:

providing a system comprising the application member of claim 50, wherein the first portion and the second portion of the at least one wall are located on substantially opposite sides of the base portion, a support coupled to the application member, the support including at least one channel, and a reservoir containing a product, the reservoir being coupled to the support, the channel enabling flow of the product from the reservoir to the passage;

placing at least some of the plurality of teeth in contact with the portion of the body;

dispensing the product onto the portion of the body via the dispensing orifice of the at least one of the teeth;

orienting the application member so that the second portion of the at least one wall of the application member faces toward a predetermined direction; and moving the application member along the, portion of the body in the predetermined direction.

53. An application member for applying a product to a surface, the application member comprising:

a base portion;

a plurality of teeth extending from the base portion, each of the plurality of teeth being formed of an elastically deformable material and comprising a free end and an end adjacent to the base portion, at least one of the teeth further comprising a dispensing orifice at the free end, and a passage configured to enable the dispensing orifice to be placed in flow communication with a reservoir containing a product; and a wall extending from a surface of the base portion in a direction substantially perpendicular to the base portion, the wall surrounding at least some of the plurality of teeth, wherein the wall and the surface of the base portion form a drip pan configured to collect product flowing from the dispensing orifice of the at least one of the teeth.

54. The application member of claim 53, wherein at least a portion of the wall has a height above the surface of the base portion substantially the same as a height of each of the plurality of teeth above the surface of the base portion.

55. The application member of claim 53, wherein the application member is a single piece, unitary construction formed of an elastically deformable material.

56. The application member of claim 53, wherein a plurality of the teeth further comprises the dispensing orifice and the passage.

57. The application member of claim 53, wherein each of the teeth further comprises the dispensing orifice and the passage.

* * * * *